United States Patent [19]

Bilsbury et al.

[11] Patent Number: 4,970,959

[45] Date of Patent: Nov. 20, 1990

[54] COLLAPSIBLE BASEWAD

[75] Inventors: Stephen J. Bilsbury, Bethlehem, Pa.; Robert J. Gardner, Bethalto; Cynthia L. Johnson, Alton, both of Ill.

[73] Assignee: Olin Corporation, Stamford, Conn.

[21] Appl. No.: 394,381

[22] Filed: Aug. 15, 1989

[51] Int. Cl.[5] ..... F42B 7/06

[52] U.S. Cl. ..... 102/450; 102/461; 102/467

[58] Field of Search ..... 102/430, 464, 465, 466, 102/467, 469, 470, 448, 449, 450, 451, 452, 453, 461, 532

[56] References Cited

U.S. PATENT DOCUMENTS

| | | | |
|---|---|---|---|
| 207,248 | 8/1878 | Bush et al. | 102/469 |
| 1,559,787 | 11/1925 | Schauerte | 102/469 |
| 2,973,711 | 3/1961 | Clark, Jr. | 102/42 |
| 3,246,603 | 4/1966 | Comerford | 102/451 |
| 3,262,392 | 7/1966 | Becker et al. | 102/451 |
| 3,359,906 | 12/1967 | Herter | 102/95 |
| 3,614,929 | 10/1971 | Herter et al. | 102/453 |
| 4,085,677 | 4/1978 | Marcinkiewicz | 102/449 |
| 4,679,505 | 7/1987 | Reed | 102/449 |
| 4,805,535 | 2/1989 | Marcon | 102/503 |

FOREIGN PATENT DOCUMENTS

| | | | |
|---|---|---|---|
| 417839 | 11/1910 | France | 102/469 |
| 1537421 | 8/1968 | France | 102/469 |

OTHER PUBLICATIONS

Translation of French Patent No. 417.839.
English translation of French #1,537,421.

*Primary Examiner*—Charles T. Jordan
*Assistant Examiner*—Stephen Johnson
*Attorney, Agent, or Firm*—John R. Wahl

[57] ABSTRACT

In combination with a cartridge case having a tubular wall and a head closing one end of the wall, a primer disposed through the head and a propellant charge in the case, a collapsible basewad is disclosed which comprises a unitary body between the charge and the head. The unitary body has an upwardly concave upper portion opening to the propellant charge and a generally cylindrical base portion. The upper portion is deflectable. These portions and the tubular wall define therebetween an annular cavity rearward of the propellant charge. This cavity is collapsed upon ignition of the propellant charge by deflection of the upper portion thereby reducing the recoil felt by the shooter without adding any parasitic weight to the projectile load. The upper portion of the basewad preferaly has an inverted truncated hollow cone shape. An upwardly open annular channel in the upper end surface of the base portion of the basewad enhances the sealing force between the base portion of the basewad and the tubular wall of the cartridge casing.

25 Claims, 1 Drawing Sheet

COLLAPSIBLE BASEWAD

This invention relates to firearm cartridges and more particularly to a basewad primarily designed for use in shotshells.

Conventional cartridges which are designed to propel a large mass projectile, especially shotshells, produce substantial recoil when fired. To counteract this recoil, conventional target load shotshell designs include a partially collapsible wad behind the load of shot. This wad cushions the shot load during acceleration, provides a gas seal between the shot load, the propellant, and the barrel during discharge, and reduces recoil. Its collapse also produces a substantial increase in initial combustion chamber volume upon ignition.

The current conventional target load shotshell wad designs have a particular disadvantage in that the presence of the collapsible portion of the wad adds substantial parasitic weight to the propelled load. This parasitic weight reduces the amount of permissible shot load in the conventional shotshell casing. It also limits the maximum velocity achievable in any particular cartridge load configuration. Finally, the recoil experienced by the shooter still remains substantial. Accordingly, there is a need for a shotshell design which reduces the parasitic load while still significantly reducing this recoil.

One attempt to provide an additional cushioning effect within a shotshell cartridge is disclosed in U.S. Pat. No. 3,359,906, issued to G. L. Herter. The basewad of this patent does not permit a reduction of parasitic load or significantly affect the initial combustion chamber volume of the shotshell upon ignition. This patent discloses a polyethylene basewad having a series of rings projecting radially outward from the cylindrical body of the wad to form a multitude of seals against the shell casing or wall. In addition, an annular ring extends outward and rearward from the bottom outer corner of the wad body contacting the head closing the end of the shotshell casing. This rearwardly directed ring forms a small shallow annular cavity between the head of the case and the bottom of the basewad. Upon firing, the basewad is pushed axially rearward against the head, collapsing the small cavity thus providing some cushioning effect. This effect would be minimal since the cavity is very shallow compared to the collapsible volume portion of present wads for target shotshells. Thus no substantial parasitic weight reduction could be achieved using this conventional design.

The primary purpose of this conventional basewad design is to positively seal the interface between the basewad and the head and the primer pocket to prevent gas leakage. Very little movement and cushioning effect is achievable with this prior art basewad design. Another limitation of this design is the lack of primer support. An annular gap or cavity between the head and the wad necessarily permits excessive primer movement relative to the casing. The primer can move axially within the wad. The head can flex forward absorbing a portion of the firing pin blow. This combination results in a soft support structure for the primer which may lead to unacceptable misfires.

Accordingly, there is a need for development of a collapsible basewad for use in a cartridge and particularly for use in a shotshell which is not ejected with the projectile, securely holds the primer, and which adds substantially to the reduction of the recoil. In addition, with the advent of steel shot loads which require additional volume for the load itself, there is a need for a shotshell design which minimizes parasitic weight and permits additional load capacity. Finally, there is a need for a method to increase the maximum velocity achievable which in turn improves the accuracy in a given shot load.

It is therefore an object of the present invention to provide a collapsible basewad which reduces the parasitic weight heretofore present in shotshell design.

It is another object of the present invention to reduce the peak chamber pressure in a shotshell cartridge which in turn reduces the recoil.

It is a still further object of the present invention to provide a shotshell cartridge permitting improved velocity characteristics.

It is a still further object of the present invention to provide a collapsible basewad which is reusable for reloading purposes.

The basewad according to the present invention is designed for use in combination with a cartridge case having a tubular wall and a head closing one end of the wall. A percussion primer is disposed centrally through the head and the basewad. A propellant charge and projectile load are also contained within the case. The collapsible basewad of the present invention is positioned between the head and the propellant charge and provides lateral support for the primer.

The collapsible basewad preferably has a unitary body having an upwardly concave upper portion which cradles the rear portion of the propellant charge. The upper portion extends from a generally solid base portion which supports the primer. The upper portion and the base portion may also be made as separate pieces, or separately formed and later joined together and then stacked within the tubular wall of the cartridge case. The main feature of the invention is that the upper portion and the base portion define therebetween an annular collapsible cavity generally axially rearward and outward of the propellant charge and forward of the base portion. The upper portion deforms to collapse this annular cavity upon ignition of the charge. The upper portion deflects rearwardly and outwardly. The collapse of the annular cavity by deflection of the concave upper portion of the basewad reduces substantially the recoil experienced by the shooter.

The deformation and deflection of the upper portion is generally elastic, with the upper portion returning to substantially its original shape after the chamber pressure has been reduced. Some plastic deformation can occur. The amount depends on the plastic material chosen for molding the collapsible basewad of the invention.

The basewad according to the present invention further preferably includes an annular upwardly open channel in the upper end of the base portion. This annular channel increases the surface area of the upper end surface of the base portion. Upon propellant ignition, the gas pressure is exerted rearwardly on this surface. The net effect is a force pushing rearwardly and outwardly on the upper end of the base portion to improve the net sealing force between the tubular wall and the basewad.

More particularly, the collapsible basewad according to the present invention preferably comprises a unitary plastic body generally symmetrical about a central axis through the body. This plastic body has an upwardly concave upper portion having upper and lower ends and an integral, generally solid, preferably cylindrical base portion. The base portion, in turn, has an upper end surface, a lower end surface and a cylindrical outer wall connecting the upper and lower end surfaces. The outer wall is sized to frictionally fit against the tubular wall of the cartridge case in a tight fitting relationship.

The lower end of the upper portion and the upper end of the base portion merge together at a location spaced inward from the outer wall. The upper portion preferably has a diverging, generally straight funnel shaped sidewall which merges into an annular top wall at the upper end. The annular top wall preferably has an outer diameter substantially equal to the inside diameter of the tubular casing wall.

The outer surface of the sidewall of the upper portion merges at its lower end in a smooth curve with the upper end surface of the base portion. The inner surface of the side wall of the upper portion merges at its lower end with an inner wall of the base portion. This inner wall of the base portion defines a bore through the base portion for receiving the primer.

The upper portion of the basewad is preferably an inverted truncated hollow cone with a generally straight sidewall. The thickness of the sidewall is preferably tapered, being thinner toward the upper end and thicker toward the base portion. This tapering minimizes the potential for fracturing of the sidewall at the merger of the sidewall with the base portion. Other shapes may also be selected depending upon the desired performance characteristics to be achieved. For example, the upper portion sidewall may have a generally bowed shape curving inwardly toward the base portion of the basewad.

The straight sidewall is preferable for providing complete propellant ignition. In addition, by making the length of the inner surface of the sidewall substantially greater than the radius of the tubular wall and positioning all of the propellant forward of the primer, an enhanced controlled propellant burn rate is achieved. This controlled burn rate provides a progressive volume of gas produced which improves the acceleration of the projectile load through the bore or barrel of the shotgun.

The base portion is preferably a generally cylindrical solid with a central axial bore therethrough for supporting the primer. The base portion may preferably be integrally molded with the upper portion as a unitary body or may be separately formed and bonded together chemically or mechanically by conventional means.

The lower end of the base portion preferably includes an annular outwardly directed flange at the merger of the outer wall and the lower end surface of the base portion for crimp engaging with the head flange to retain the basewad firmly in position against the head within the shotshell. In addition, this flange, when crimped, provides a positive seal between the basewad and the head.

When the propellant is ignited, the sidewall of the upper portion deflects and expands outward and rearward in a generally elastic manner, collapsing the cavity and absorbing some of the pressure shock. This motion reduces the peak chamber pressure and the attendant recoil force felt by the shooter. Immediately upon depressurization as the projectile load leaves the barrel of the firearm, the upper portion of the basewad returns to substantially its original shape. Thus the basewad according to the present invention is also suitable for use in reloadable ammunition.

Although the basewad according to the present invention is shown and described for use in a shotgun shell, the collapsible basewad according to the present invention may also be utilized in other cartridge case designs and thus would have a slightly modified configuration than as specifically described and shown in the drawings herein. Further objects, features and advantages of the invention will become apparent from consideration of the following description and the appended claims when taken in conjunction with the accompanying drawing.

Figure 1:
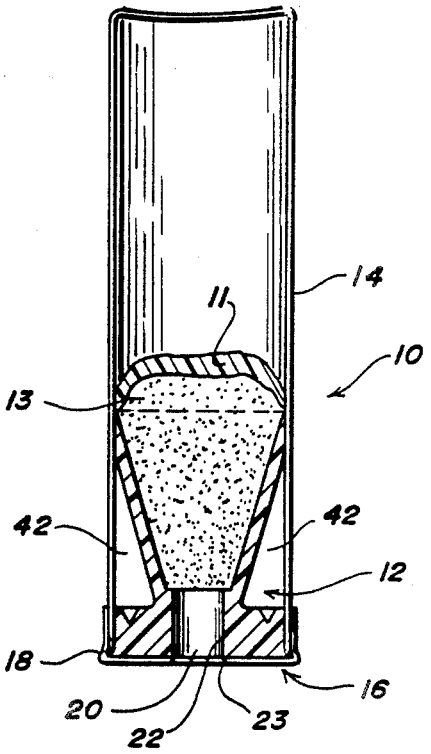
FIG. 1 is a longitudinal partial sectional view of a shotshell casing having therein a collapsible basewad according to the present invention.

Turning now to the drawings, a shotshell 10 including a basewad 12 according to the present invention is shown in partial section in FIG. 1. Shotshell 10 includes a tubular wall 14, preferably a Reifenhauser tube of biaxially oriented thermoplastic, which houses in series a shot load (not shown), a conventional wad structure 11, a propellant charge 13, the basewad 12, and a metal head 16. The metal head 16 has a circular crimped flange 18 which crimp engages part of basewad 12 and the end of tubular wall 14 locking them together. Finally, a primer 20 is frictionally secured in central through bores 22 and 23 in basewad 12 and head 16 respectively.

Figure 2:
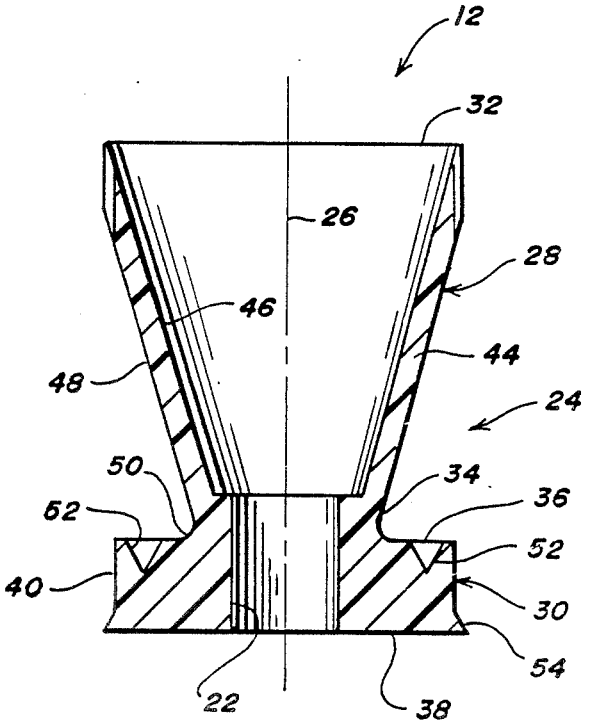
FIG. 2 is an enlarged sectional view of the basewad according to the present invention.

The basewad 12 in accordance with the present invention, as shown in FIG. 2, is preferably a unitary plastic body 24 which is generally symmetrical about a central axis 26 therethrough. The basewad body 24 includes an upwardly and outwardly opening funnel shaped upper portion 28 and preferably a generally cylindrical base portion 30. The upper portion 28 has upper and lower ends 32 and 34 respectively. The lower end 34 merges integrally with the generally cylindrical base portion 30. The upper end 32 of upper portion 28 and the cylindrical base portion 30 are preferably circumferentially sized to frictionally fit against the inside surface of tubular wall 14.

The base portion 30 is generally a right circular cylindrical solid and has upper and lower annular end surfaces 36 and 38 which extend radially outward from central axis 26. The upper and lower end surfaces 36 and 38 are connected at their outer perimeters with a cylindrical outer wall 40. The outer wall 40 is preferably sized to frictionally fit against the tubular wall 14 when basewad 12 is inserted therein as described above. The bore 22 extends axially along central axis 26 through base portion 30 and upper portion 28.

The lower end 34 of the upper portion 28 merges with the upper end surface 36 of the base portion 30 substantially inward of the outer wall 40. This forms an annular cavity 42 as shown in FIG. 1, between the upper portion 28, the lower portion 30, and the tubular wall 14.

The upper portion 28 of basewad 12 is shown, in FIG. 2, as an inverted, truncated cone having a substantially straight sidewall 44 with inner and outer side wall surfaces 46 and 48, respectively. Alternative embodiments of the present invention may have an upper portion having various shapes of sidewalls such as a curved sidewall forming a dish or cup shaped funnel.

The outer surface 48 of the sidewall 44 of the upper portion 28 merges with the upper end surface 36 of the base portion 30 in a smooth curve 50 which reduces any areas of stress concentration that can occur during deflection of the sidewall 44 under the extreme pressures encountered during ignition of the propellant. The lower end of the inner surface 46 of the upper portion 28 merges with the though bore 22 for passage of the ignition flame from the primer 20 into the propellant 13 at a point axially spaced from upper end surface 36. This axial spacing further distributes the stresses during deflection thus enhancing the elastic character of the upper portion 28 and minimizing fatiguing of the plastic at the lower end 34 of the upper portion 28.

The lower end of inner surface 46 of sidewall 44 also merges with the base portion 30 above the location of curve 50 and end surface 36 at a raised ledge or shoulder 51. The ledge 51 effectively spaces the sidewall 44 of the upper portion 28 radially outward of the bore 22 and provides a hinge point for outward deflection of the upper portion 28 that is spaced from the primer bore 22. This radial spacing of the lower end of sidewall 44 from upper end surface 36 ensures that the outward deflection of the sidewall 44 will not inhibit the sealing capability between the primer 20 within bore 22 and base portion 30.

The base portion 30 preferably has an upwardly open annular channel 52 in the upper end surface 36 outwardly of the merger of the upper and lower portions 28 and 30, respectively. This channel 52 preferably has a V-shape as will be subsequently explained.

Finally, a flange ring 54 is integrally formed at the merger of the lower end surface 38 with the outer wall 40. The flange ring 54 is crimped within the head flange 18 along with the lower end of the tubular wall 14 as shown in FIG. 1. This positively seals and secures the basewad 12 in place at the end of the tube 14. This also firmly secures basewad 12 to the head 16 so that end surface 38 firmly contacts head 16. This contact minimizes any flexing of the head 16 and primer movement to ensure consistent firing pin impact and primer ignition.

Figure 3:
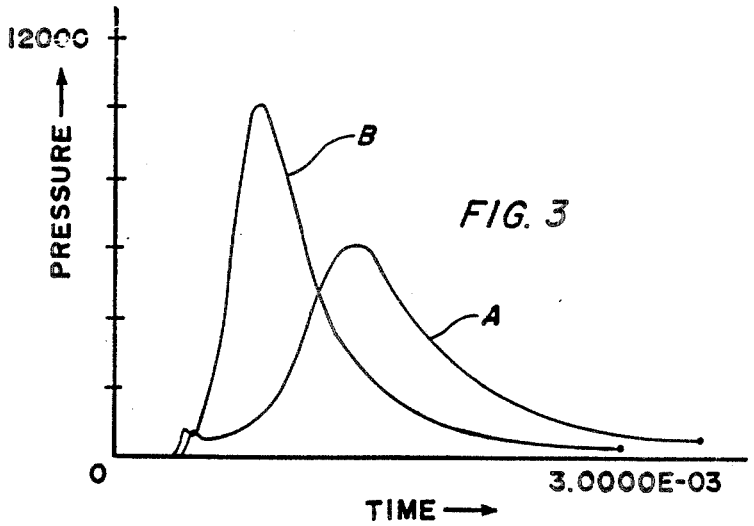
FIG. 3 is an illustrative graph of chamber pressure versus time for a conventional shotshell and a shotshell containing the basewad according to the present invention.

The basewad 12 according to the present invention functionally places the propellant charge 13 in front of the primer cavity 22 and specifically provides a collapsible annular expansion cavity 42 rearward of the propellant charge and outwardly thereof. In operation, when the propellant 13 is ignited by the primer 20, increasing gas pressure is exerted against the inside surface 46 of the sidewall 44 of the upper portion 28. When a sufficient pressure is reached, outward and rearward deflection of the sidewall 44 collapses the annular cavity 42. This collapse of cavity 42 by the elastic deflection of the sidewall 44 increases the available interior volume of the shotshell powder chamber for gas expansion. It also decreases and delays the maximum chamber pressure reached as illustrated in FIG. 3 and the corresponding recoil is reduced. After the projectile load has been ejected from the barrel of the shotgun pressure is reduced and the upper portion 28 springs back to its original shape.

Turning now to FIG. 3, Curve A is a pressure-time curve for shotshell having a basewad according to the present invention included therein. Curve B illustrates the pressure time response for a conventional shotshell having a solid basewad. As can readily be seen, the peak pressure achieved in a shotshell including the collapsible basewad according the present invention (curve A) is much lower and delayed, compared to that of the conventional shotshell (curve B). This decrease in peak pressure and delay in occurrence of the peak pressure correlates to a substantial reduced recoil force felt by the shooter. This reduced recoil leads to less shooter fatigue which is very desirable, especially for target loads where, many rounds are fired in a relatively short time.

The basewad according to the present invention is preferably made of a linear thermoplastic material such as polyethylene. However, the basewad may also be made of a thermoplastic polyester elastomer or other suitable material having the elastic deformation and high temperature and low temperature operability characteristics required of wads for sporting ammunition.

During the propellant burn, gas pressure is also applied rearwardly against the upper end surface 36 of base portion 30. The presence of the upwardly open annular channel 52 effectively increases the surface area against which the gas pressure acts. As base portion 30 is solid, this produces a net outwardly directed force on the outer wall 40 in contact with the tubular wall 14 near the end surface 36. This force enhances the seal between the base portion 30 and the tubular wall 14. In addition, the crimp 18 on the flange portion 54 and the tubular wall 14 within the head 16 provides an additional seal to prevent propellant gases escaping from the rear of the shotshell 10.

The collapsible basewad 12 of the present invention permits the use of a wad structure 11 behind and enclosing the load of pellets which is smaller and has less collapsible volume. Accordingly, a larger pellet volume may be utilized such as is desirable in the case of steel shot. In addition, the wad structure 11 may have less mass. Therefore parasitic mass can be greatly reduced. A substantial collapsible wad structure 11 in front of the propellant charge may no longer be needed.

The basewad according to the present invention has been described above in an illustrative manner. It is to be understood that the terminology that has been used is intended to be in the nature of words of description rather than of limitation. Obviously, many variations and modifications of the present invention are possible in light of the above teachings.

For example, the basewad according to the present invention may be comprised of a basewad of conventional design and a separate upwardly concave upper portion as above described positioned against the conventional basewad so as to form the collapsible cavity rearward and outward of the propellant charge and forward of the conventional basewad. Alternatively, the basewad according to the invention may include a tubular wall joining the outer wall of the basewad to the upper end of the upper portion forming and enclosing the annular cavity. In this alternative, the tubular wall would simply be an upward extension of the outer wall 40 between upper end surface 36 and upper end 32. It is therefore to be understood that within the scope of the appended claims the basewad according the present invention may be practiced otherwise than as specifically described.

What is claimed is:

1. In combination with a cartridge case having a tubular wall and a head closing one end of said tubular wall and an open end opposite said one end, a primer disposed in said head, and a propellant charge in said case, a collapsible basewad comprising:

A unitary plastic body between said charge and said head spacing said charge from said head, said body having a resiliently deflectable concave upper portion expanding upwardly toward said open end and a generally cylindrical base portion, said body portions and said tubular wall defining therebetween a collapsible annular cavity rearward of said propellant charge and forward of said base portion, a major portion of said upper portion being adapted to deflect rearwardly and outwardly against said tubular wall to collapse said cavity in response to pressure increase within the case forward of the upper portion resulting from ignition of said charge, said upper portion adapted to rebound to automatically substantially restore said cavity following decrease of said increased pressure.

2. In combination with a cartridge case having a tubular wall and a head closing one end of said tubular wall and an open end opposite said one end, a primer disposed in said head, and a propellant charge in said case, a collapsible basewad comprising:

a unitary body between said charge and said head spacing said charge from said head, said body having a concave upper portion expanding upwardly toward said open end and a generally cylindrical base portion, said body portions and said tubular wall defining thereafter a collapsible annular cavity rearward of said propellant charge and forward of said base portion, said upper portion operably deflecting rearwardly and outwardly to collapse said cavity wherein said base portion has an annular upwardly opening channel therein communicating with said cavity.

3. In a cartridge case containing a propellant charge and having a tubular casing wall and a head closing one end of said wall and an open end opposite said one end, a collapsible basewad behind said charge and adjacent said head comprising:

a unitary plastic body symmetrical about an axis through said body, said body having a resiliently deflectable upwardly concave upper portion expanding upwardly toward said open end and having upper and lower ends and a generally cylindrical base portion;

said base portion having an upper end surface and a lower end surface and an outer wall connecting said upper and lower and surfaces, said outer wall abutting said tubular wall in a tight fitting relationship; and said lower end of said upper portion merging with said upper surface of said base portion at a location spaced inward of said outer wall forming an annular cavity between said body portions and said tubular wall, a major portion of said upper portion being adapted to deflect resiliently rearwardly and outwardly against said tubular wall to collapse said cavity in response to pressure increase within the case forward of the upper portion resulting from ignition of said charge, said upper portion adapted to rebound to automatically substantially restore said cavity following decreases of said increased pressure.

4. The basewad according to claim 3 wherein said upper portion has an upwardly diverging generally straight sidewall having inner and outer surfaces merging with an annular top wall at said upper end.

5. The basewad according to claim 4 wherein said outer surface of said sidewall of said upper portion merges at its lower end in a smooth curve with said upper end surface of said base portion.

6. The basewad according to claim 4 wherein said annular top wall of said upper portion engages said tubular casing wall to form a tight fitting seal therebetween.

7. The basewad according to claim 3 wherein said base portion has an upwardly open annular channel in the upper end surface outwardly of said location, said channel communicating with said cavity.

8. The basewad according to claim 7 wherein said channel has a V shape.

9. The basewad according to claim 7 wherein said upper portion is an inverted truncated hollow cone.

10. The basewad according to claim 3 wherein said base portion has an annular outwardly directed flange joining said outer wall and said lower end surface of said base portion wherein said outwardly directed flange engages said head.

11. The basewad according to claim 3 wherein said cartridge is a shotshell.

12. In a shotshell having a tubular casing wall for retaining a propellant and a flanged head closing one end of said wall and an open and opposite said one end, a collapsible basewad adjacent said head and within said tubular casing wall comprising:

a unitary plastic body symmetrical about an axis through said body, said body having a central bore therethrough for receiving a primer, said body having and upwardly and outwardly opening funnel shaped resiliently deflectable upper portion expanding toward said open end, said upper portion having upper and lower ends, said lower end merging with an integral generally cylindrical base portion, said upper end of said upper portion being sized to fit within said tubular casing wall;

said base portion having an upper end surface and a lower end surface and an outer wall connecting said end surfaces, said outer wall abutting said tubular wall in a tight fitting frictional relationship; and said lower end of said upper portion merging with said upper end of said base portion inward of said tubular casing wall forming an annular cavity between said body portions and said tubular wall, a major portin of said upper portion being adapted to resiliently deflect rearwardly and outwardly against said tubular wall to collapse said cavity in response to pressure increase within said casing wall forward of said upper portion resulting from ignition of said propellant, said upper portion adapted to rebound to automatically substantially restore said cavity following decrease of said increased pressure.

13. The basewad according to claim 12 wherein said lower end of said funnel shaped upper portion merges in a smooth curve with said upper end surface of said base portion.

14. The basewad according to claim 13 wherein said base portion has an upwardly open annular channel in the upper end surface outwardly of said smooth curve.

15. The basewad according to claim 14 wherein said channel has a V shape.

16. The basewad according to claim 13 wherein said lower end surface and said outer wall of said base portion merge in an outwardly directed flange wherein said outwardly directed flange engages said flanged head.

17. A collapsible basewad for use in a cartridge case having a tubular wall and a head closing one end of said tubular wall said case containing a propellant charge therein, said basewad comprising:

a unitary plastic body having a generally concave resiliently deflectable upper portion forming a cup to retain said propellant charge and a base portion, said body portions defining, when said basewad is positioned within said tubular wall of said case between said head and behind said charge, a collapsible cavity, a major portion of said upper portion being adapted to deflect rearwardly and outwardly against said tubular wall to collapse said cavity in response to pressure increase within said case forward of said upper portion resulting from ignition of said charge, said upper portion adapted to resiliently rebound automatically to an undeflected position substantially reforming said cavity following decrease of said increased pressure.

18. The basewad according to claim 17 wherein said base portion is a generally solid cylindrical body symmetrical about a central axis through said portions.

19. The basewad according to claim 18 wherein said upper portion has a generally truncated conical shape.

20. The basewad according to claim 19 wherein said upper portion has upper and lower ends and has an upwardly diverging generally straight sidewall having inner and outer surfaces merging with an annular top wall at said upper end.

21. The basewad according to claim 20 wherein said outer surface of said sidewall of said upper portion merges at its lower end in a smooth curve with said base portion.

22. The basewad according to claim 19 wherein said annular top wall of said upper portion is sized to engage said tubular casing wall to form a frictional fitting seal therebetween.

23. The basewad according to claim 21 wherein said base portion has an upwardly open annular channel therein outwardly of said smooth curve, said channel communicating with said cavity.

24. The basewad according to claim 23 whereinh said channel has a V shape.

25. The basewad according to claim 22 wherein said cylindrical base portion has an outer wall sized to frictionally fit within said tubular casing wall, said lower end of said sidewall of said upper portion being spaced inward of said outer wall.

* * * * *